US006523702B1

(12) United States Patent
Primiano et al.

(10) Patent No.: US 6,523,702 B1
(45) Date of Patent: Feb. 25, 2003

(54) INCLINED MERCHANDISING DISPLAY TRACK DEVICE

(75) Inventors: Bernard Primiano, Marietta, GA (US); Ming Sun, Roswell, GA (US)

(73) Assignee: Display Industries, LLC, Smyrna, GA (US)

( * ) Notice: Subject to any disclaimer, the term of this patent is extended or adjusted under 35 U.S.C. 154(b) by 0 days.

(21) Appl. No.: 10/022,701

(22) Filed: Nov. 29, 2001

Related U.S. Application Data

(63) Continuation-in-part of application No. 09/999,317, filed on Oct. 31, 2001.

(51) Int. Cl.[7] ..... A47F 1/04

(52) U.S. Cl. ..... 211/59.2; 211/183; 211/175; 248/242

(58) Field of Search ..... 211/59.2, 59.3, 211/175, 184, 183, 74, 186, 187, 188, 90.02; 312/42, 45, 71, 72; 108/1, 8, 4; 248/242, 241, 274.1

(56) References Cited

U.S. PATENT DOCUMENTS

| | | | | | |
|---|---|---|---|---|---|
| 4,593,823 | A | * | 6/1986 | Fershko et al. | 211/133.1 |
| 4,685,574 | A | * | 8/1987 | Young et al. | 211/184 |
| 4,724,968 | A | * | 2/1988 | Wombacher | 211/184 |
| 4,730,741 | A | * | 3/1988 | Jackle et al. | 211/59.3 |
| 4,785,943 | A | * | 11/1988 | Deffner et al. | 211/128.1 |
| 4,938,442 | A | * | 7/1990 | Mastrodicasa | 248/250 |
| 4,958,739 | A | * | 9/1990 | Spamer | 211/153 |
| 4,997,094 | A | * | 3/1991 | Spamer et al. | 211/153 |
| 5,024,336 | A | * | 6/1991 | Spamer | 211/153 |
| 5,050,748 | A | * | 9/1991 | Taub | 211/126.1 |
| 5,240,126 | A | * | 8/1993 | Foster et al. | 211/175 |
| 5,353,939 | A | * | 10/1994 | Beeler et al. | 211/184 |
| 5,457,859 | A | * | 10/1995 | Kacprowicz et al. | 211/59.2 |
| 5,458,248 | A | * | 10/1995 | Alain | 211/153 |
| 5,634,564 | A | | 6/1997 | Spamer et al. | 211/59.3 |
| 5,638,963 | A | * | 6/1997 | Finnelly et al. | 211/59.3 |
| 5,645,176 | A | * | 7/1997 | Jay | 211/59.2 |
| 5,685,664 | A | * | 11/1997 | Parham et al. | 211/59.3 |
| 5,788,091 | A | * | 8/1998 | Robertson et al. | 211/59.2 |
| D401,436 | S | * | 11/1998 | Jay | D6/408 |
| 5,862,923 | A | | 1/1999 | Nordquist et al. | 211/59.2 |
| 6,082,556 | A | * | 7/2000 | Primiano et al. | 211/59.2 |
| 6,142,316 | A | * | 11/2000 | Harbour et al. | 211/59.2 |
| 6,325,221 | B2 | * | 12/2001 | Parham | 211/183 |
| 2001/0002658 | A1 | * | 6/2001 | Parham | 211/59.2 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

An elongate display track device has front and rear segments. The front segment has sidewalls with vertical channels therein to receive arm to support a product identification panel. A detent in each channel engages the scalloped surface of the bottom portion an arm to adjust the vertical position of the product identification panel. A foot is connected to the rear segment to elevate the rear of the track to assist gravity feed.

12 Claims, 6 Drawing Sheets

INCLINED MERCHANDISING DISPLAY TRACK DEVICE

CROSS-REFERENCE TO RELATED APPLICATIONS

This application is a continuation-in-part of Ser. No.: 09/999,317 filed Oct. 31, 2001.

TECHNICAL FIELD OF THE INVENTION

This invention relates to a track device for a merchandising display shelf, and, more particularly, to a gravity feed track device for articles on the shelf, particularly bottles, to slide along.

BACKGROUND OF THE INVENTION

A display rack unit is assembled from multiple track devices for merchandising articles such as bottled on canned drink products. The display rack unit typically includes a plurality of elongated track devices detachably interconnected in side-by-side relationship at adjacent sidewalls. The number of track devices used to assemble the display rack unit is determined such that the size of the unit is suitable for placement onto an existing display shelf in a retail environment to fill the width of the shelf.

Articles in the track can be moved from the rear to the front for dispensing one at a time using pusher mechanisms or using gravity. Pusher mechanisms have many separate components that increase the cost and complexity of the track devices. Gravity feed track devices are typically less expensive and simpler than pusher devices. Gravity feed can be achieved easily with a simple track device when the shelf on which the track device rests is inclined. When the shelf is not inclined but has an upwardly extending rear lip, ledge or back stop, gravity feed is still easily achieved with a simple track device that rests on the back stop to raise the rear of the device. For other flat shelves, the track device itself must provide the incline.

One device that provides the incline is disclosed in U.S. Pat. No. 5,788,090 wherein a display unit with rollers disposed on an incline to effect gravity feed. The unit includes a horizontal bottom panel and a vertical rear panel that support roller supports which are inclined. While gravity feed is achieved with the incline, rollers and other structural components are required thereby increasing cost and complexity. Also, the incline is a permanent part of the structure making the unit useable only with flat shelves. Accordingly, it will be appreciated that it would be highly desirable to have a cost effective, relatively simple track device that can be used with both flat and inclined shelves.

An unfortunate problem with beverage bottles in track devices is that the product labels do not always face forward thereby obscuring product identification. Some track devices have a front piece that provides an area for a product label along the bottom of the front piece. While such an area on the front piece improves product identification, the area sometimes obscured by the shelving or the refrigerator unit. It will be appreciated that it would be highly desirable to have track device with a front piece or front segment that provides a product identification area that is not obscured by the shelf or the refrigerator unit.

SUMMARY OF THE INVENTION

The present invention is directed to overcoming one or more of the problems set forth above. Briefly summarized, according to present the invention, an elongate display track device for receiving a row of articles for sliding movement therealong comprises front and rear track segments. The front track segment has base wall with opposed sidewalls upstanding from the base wall.

The rear track segment has a base wall with opposed sidewalls upstanding from the base wall. The base wall has top and bottom surfaces and defines first and second openings disposed between the sidewalls. Each opening has first and second opposed edges. A rear end wall is attached to the base wall and the sidewalls. A first flange is attached to the bottom surface of the base wall adjacent the first edge of the first opening and extends toward the second edge of the first opening. A second flange is attached to the rear end wall adjacent the second edge of the second opening and extends therefrom toward the first edge of the second opening and toward the first flange. A foot is attached to the first and second flanges and extends downwardly from the bottom surface of the base wall.

The foot and the base wall are connected at an angle so that when the foot is oriented vertically the base wall slants downwardly with the second opening being at a higher elevation than the first opening. The angle permits the foot to stand upright with the base wall of the track device slanted downward toward the front for urging the containers toward the front.

The foot has a plurality of parallel ribs extending downwardly from a bottom portion of the foot. The ribs are adapted to engage wires of a wire shelf to prevent lateral movement of the foot thereby making the inclined track device more stable.

The front segment has first and second upwardly extending arms adjustably attached thereto Each arm has a top portion and a bottom portion with a scalloped surface. A product identification panel is attached to the top portion of the arms. Each sidewall of the front track segment defines a channel that extends transversely along the sidewall perpendicular to the base wall of the front track segment. Each channel has a detent at a top portion thereof adapted to engage the scalloped surface of the bottom portion of one of the arms so that the height of the product identification panel can be adjusted.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

A display rack unit is typically assembled from multiple track devices 10 and is designed to merchandise articles such as bottled or canned drink products. A typical display rack unit includes a plurality of elongated track devices 10 detachably interconnected in side-by-side relationship. The number of track devices used to assemble the display rack unit is determined such that the size of the unit is suitable for placement onto an existing display shelf in a retail environment. The interconnection of two adjacent track devices is conventionally achieved by connecting means such as connector slots cooperating with L-shaped horizontal connector elements. Details of such track devices and connector elements are more fully described in U.S. Pat. No. 5,634,564, which issued Jun. 3, 1997 to Spamer et al., the disclosure of which is incorporated herein by reference.

Figure 1:
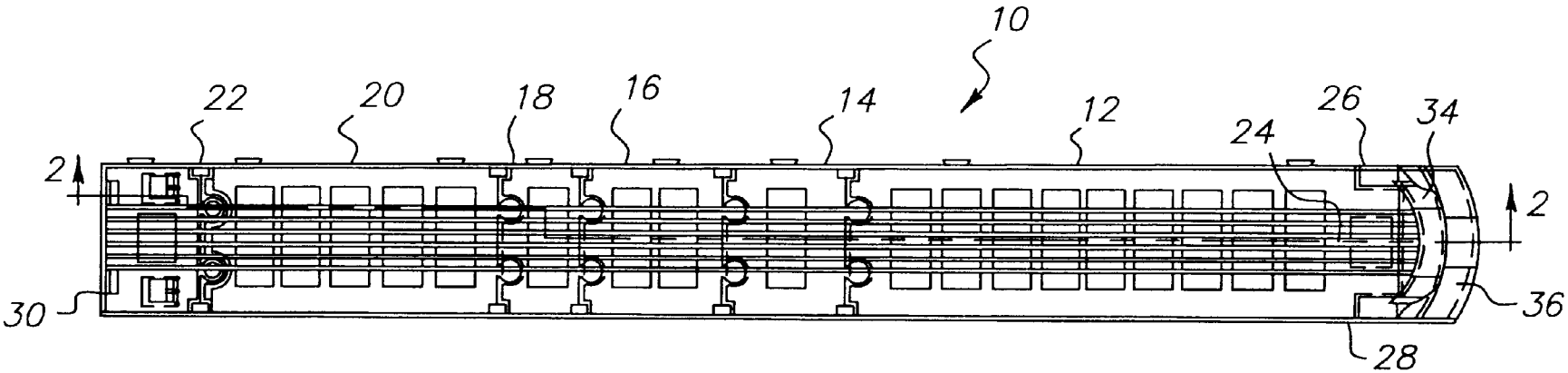
FIG. 1 is a top view of a preferred embodiment of a track device according to the present invention.
Figure 2:
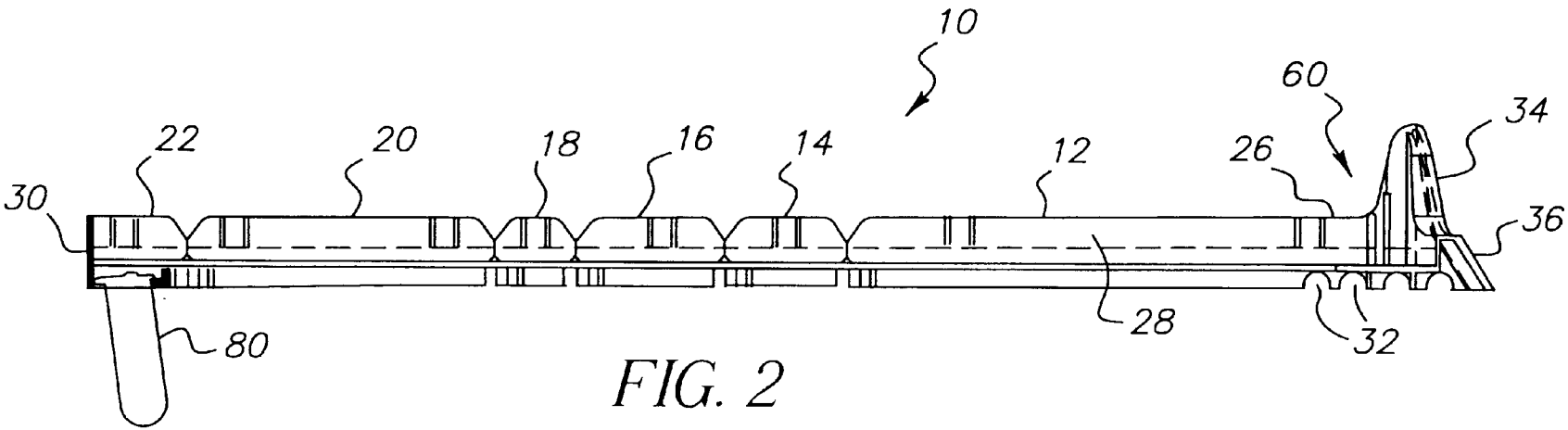
FIG. 2 is a sectional view of the adjustable length track device taken along line 2—2 of FIG. 1.
Figure 3:
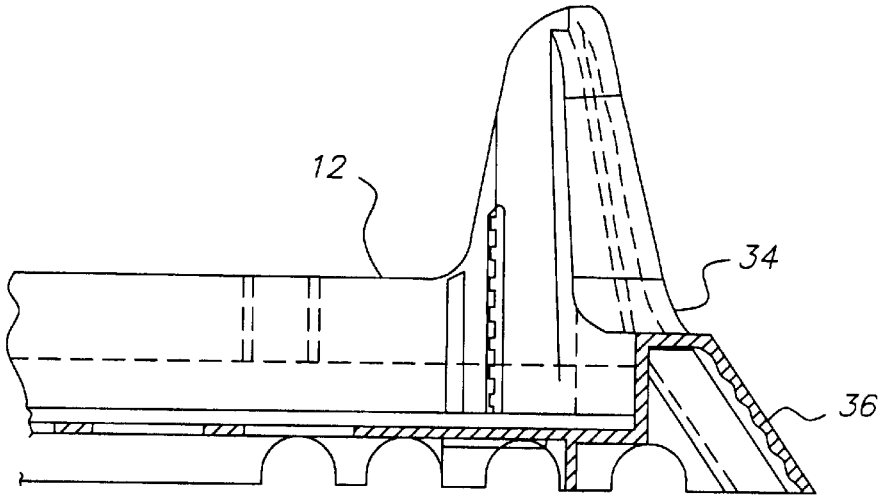
FIG. 3 is somewhat enlarged sectional view of the front track segment of FIG. 1.

Referring to FIGS. 1–2, an elongated display track device 10 receives a row of articles for sliding movement therealong. Display track device 10 is composed of a number of individual segments or segments that are frangibly connected end-to-end to one another. A frangible connection may be made by connecting two segments of normal thickness with a small segment of the same, but thinner, material with the thinner material forming a fracture line along which the segments can be easily separated. There is a front segment 12 that is connected to a first intermediate segment 14 along a fracture line. First intermediate segment 14 is connected to a second intermediate segment 16 along a fracture line and is connected to a third intermediate segment 18 along another fracture line. Third intermediate segment 18 is connected along a fracture line to a fourth intermediate segment 20. A rear segment 22 is connected to intermediate segment 20 along a fracture line. Any one or all of intermediate segments 14, 16, 18, 20 may be removed with rear segment 22 then connecting to either the front segment 12 or to any intermediate segment remaining that is nearest the rear segment 22. Such track segments are more fully described in co-pending application Ser. No.: 09/999,317, the disclosure of which is incorporated herein by reference.

The front track segment 12 has a floor or base wall 24 with opposed upstanding sidewalls 26, 28 forming a channel for a single row of articles to slide along between the sidewalls 26, 28. Base wall 24 has a front end portion that will be disposed at the front of the display shelf and a rear end portion that defines a keyway or other means for connecting to an intermediate track segment or the rear track segment.

The rear track segment 22 also has a base wall with opposed upstanding sidewalls. The base wall has a front end portion defining a key or other means for connecting to an intermediate track segment or the front track segment. A rear panel 30 is upstanding from the base wall of the rear track segment 22 and stretches across the rear of the track device to strengthen the structure. Rear panel 30 is preferably integrally formed with the base wall and upstanding sidewalls of the rear segment but may be detachably connected thereto with a tongue and groove connection, for example.

The left and right sidewall panels 26, 28 of the front track segment 12 define one or more recesses 32 along their bottom edges. These recesses 32 are adapted to engage and rest on a wire of a wire shelf to inhibit forward movement of the track device relative to the wire shelf. When used on a shelf, the shelf may be flat or horizontal, or it may be inclined so that the rear of the shelf is at a higher elevation than the front of the shelf to help articles slide forward to the front of the shelf. In either case, the recesses will engage either one of the wire mesh members or a ledge, lip or ridge running along the front of the shelf to prevent movement of the track device. Where the shelf is inclined, the recesses are critical because the track device will have a tendency to slide forward on the shelf, or possibly off the shelf completely. There are preferably several recesses 32 to project different lengths of the track device forward to fill space between the front of the shelf and the door of the cooler to make product dispensing more convenient.

Referring to FIGS. 1–4, the front track segment 12 has a front piece 34 that acts as a front stop for articles in the track. As articles are placed in the track from the rear they slide forward and come to rest against front piece 34. Front piece 34 has a panel 36 that extends along a bottom edge portion thereof for displaying product labels or other product identification or information. A top edge of panel 36 is preferably positioned at a higher elevation than the elevation of the bottom wall 24 of the front track segment 12 while a bottom edge of panel 36 is at a lower elevation than the base wall. Front piece 34 has side panels that project into the path of the articles to prevent the articles sliding out the front of the track. Front piece 34 is preferably integrally formed with front track segment 12 but may be a separate member connected to front track segment 12.

Figure 4:
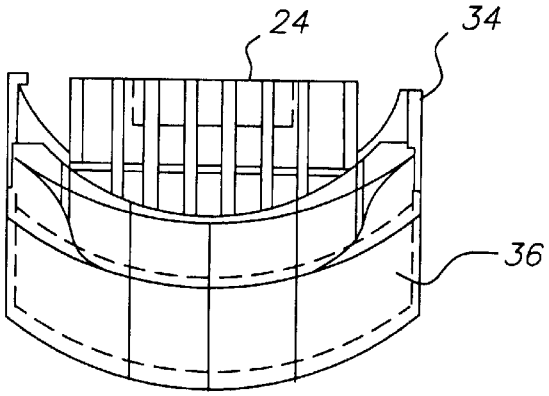
FIG. 4 is a somewhat enlarged top view of the front track segment of FIG. 1.
Figure 5:
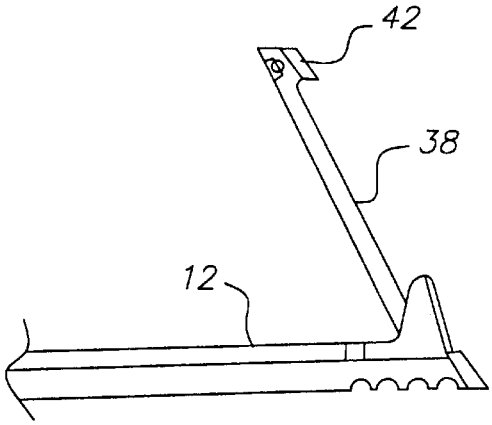
FIG. 5 is a side view of the front track segment with product identification panel installed.
Figure 9:
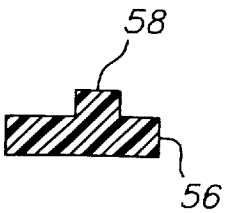
FIG. 9 is a sectional view taken along line 9—9 of FIG. 8.
Figure 8:
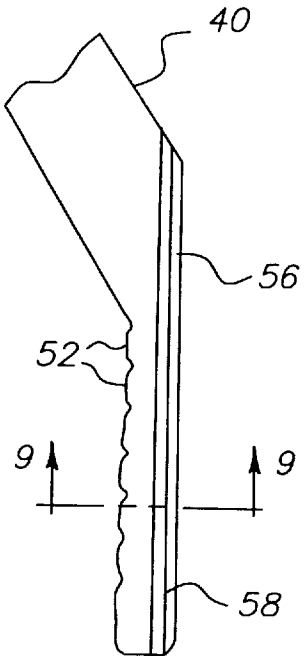
FIG. 8 is a side view of a portion of the right support arm illustrating the scallops and channel.
Figure 7:
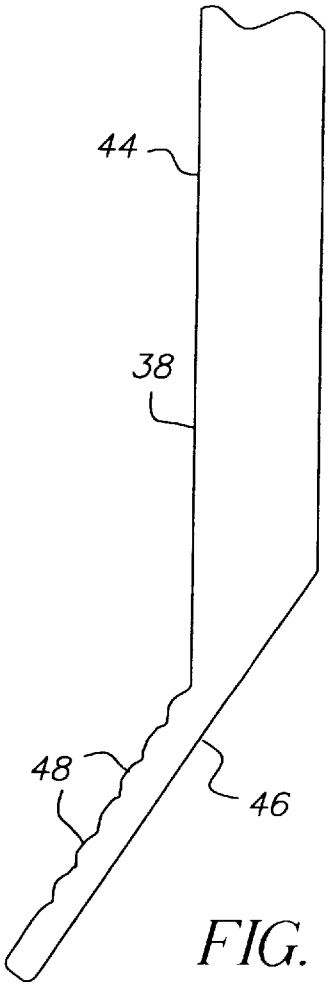
FIG. 7 is a side view of a portion of the left support arm illustrating the bend and scallops.
Figure 6:
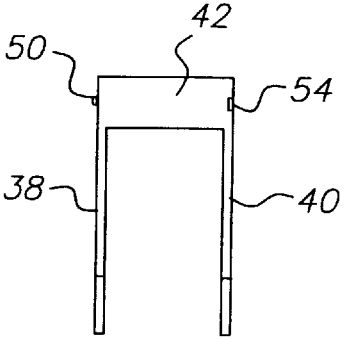
FIG. 6 is front view of the support arms and attached panel.

Panel 36 is preferably slanted with the top edge of the panel tilted inward toward the front track segment 12, and with a bottom edge of panel 36 tilted away from front track segment 12. As viewed in FIGS. 2–3, panel 36 makes an acute angle with a projection of the base wall 24. An angle of about 55° is most preferred, but an angle in a range from about 30° to about 70° is preferred. Angles below this range tilt the panel inward too much either wasting space interfering with the articles. Angles above this range tilt the panel outward too little much making the product identification difficult to read. Panel 36 is preferably curved with a middle portion of the panel extending away from front track segment 12 more than either side edge of the panel giving panel 36 a curved or rounded appearance when viewed from the front (FIG. 4). Panel 36 actually has a convexoconcave configuration.

Referring now to FIGS. 5–9, the track device has first and second upwardly extending arms 38, 40 that are detachably connected to the front track segment 12 of the track device 10. Detachable arms facilitate compactness for shipping the units. A panel 42 is attached to a top portion of the arms 38, 40. Panel 42 is curved similar to the front piece panel 36 with side edges of panel 42 extending rearward toward the rear track segment 22 more than a middle portion of the panel 42. The panels provide areas for placing labels, decals or other product identification. The arms are angled such and have a length such that the panel 42 does not interfere with articles placed on the track device, and, preferably, is positioned behind the first article at the front of the display track that is to be removed. The angle between the upper and lower portions of each arm is preferably between about 30° to about 50°. A lesser angle causes the top panel 42 to interfere with the tops of articles while a greater angle fails to place panel 42 behind the lead article. The top panel supported on the arms is above and behind the lead article while the front piece panel is generally below but forward of the articles. Placing product identification labels or decals on the upper and lower panels makes product orientation less critical.

Arm 38 has a top portion 44 and a bottom portion 46. The rear side of bottom portion 46 has a series of protrusions, preferably scallops 48, for adjusting the height of top panel 42. The top portion 44 has a protrusion 50 for connecting to an adjacent track device via a slot in the adjacent track device. The top portion of arm 40 has a slot 54 that can receive a protrusion form an adjacent track device to connect the two track devices together.

Arm 40 has a bottom portion 56 with a rear side having scallops 52 for adjusting the height of top panel 42. Arm 40 contains a spline or rib 58 that extends from the lower edge of bottom portion 56 to the main portion of arm 40. When assembled, rib 58 is substantially perpendicular to the base wall of the front segment 12 causing top panel 42 to be supported behind the front piece 34.

Figure 10:
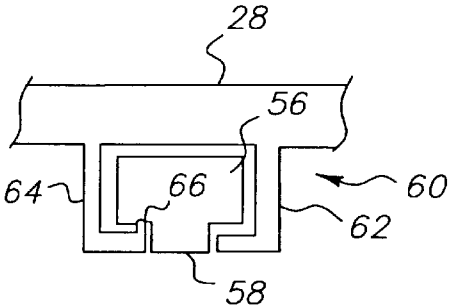
FIG. 10 is a top view of the right sidewall channel illustrating the detent.
Figure 11:
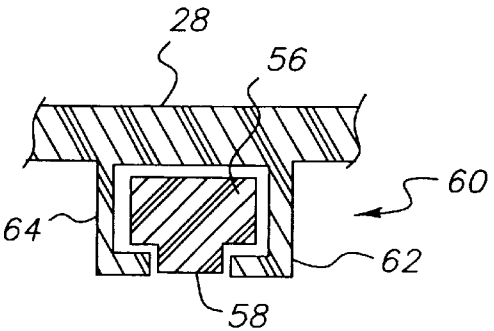
FIG. 11 is a sectional view of the right sidewall channel below the detent.
Figure 15:
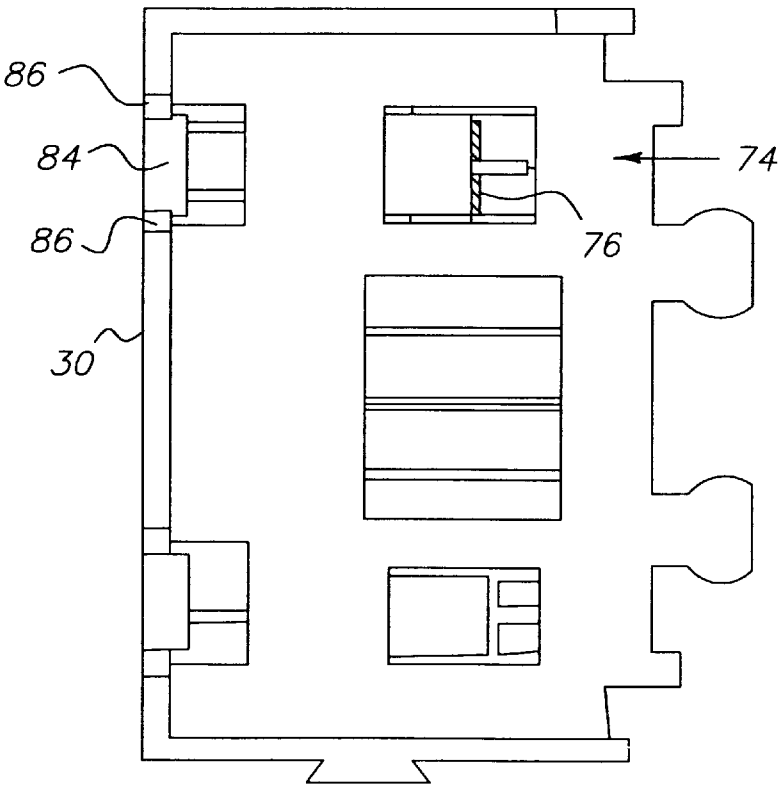
FIG. 15 is a somewhat enlarged bottom view of the rear track segment of FIG. 14.
Figure 14:
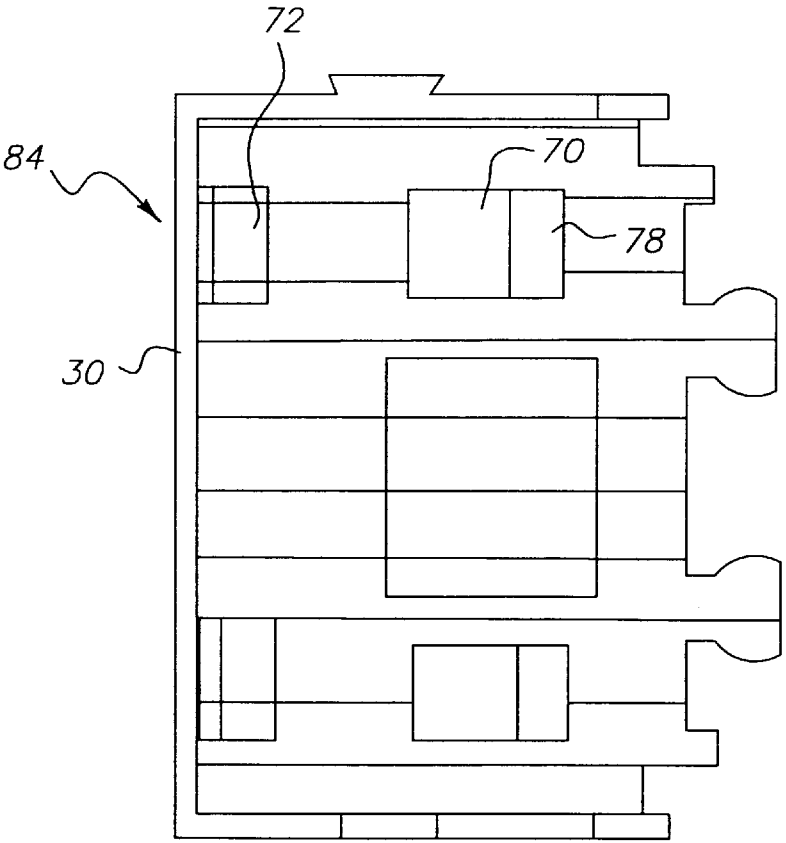
FIG. 14 is a somewhat enlarged top view of the rear track segment of FIG. 1.

Referring to FIGS. 10–11, each of the sidewalls 26, 28 of front track segment 12 define a groove or channel 60 extending transversely therealong generally perpendicular to base wall 24. Channel 60 for right sidewall 28 includes front and rear L-shaped rails 62, 64 that are spaced apart to receive the bottom portion of right arm 40. A detent 66 at the top of the rear rail 64 engages the scalloped surface 52 of the bottom portion of right arm 40 to hold top panel 42 at a selected height. Single detent 66 which exists at the top portion of channel 60 has been found sufficient to hold the arm and panel in position. If desired, double detents could be used with the second detent disposed below the first detent 66. The left sidewall 26 is similarly configured with the channels on the interior or inboard side of the arms so that they face one another. As an alternative, the channel could be formed as grooves without causing a protrusion from the sidewalls. Also, equivalently, the channels could be scalloped with detents present on the arms. Scallops are preferred on the arms however to make manufacturing easier and less expensive.

Referring to FIGS. 12–15, the base wall of the rear track segment 22 has front and rear openings 70, 72 disposed between the sidewalls. Each opening has opposed front and rear edges with the front edge being nearer to front segment 12 than the rear edge which is nearer to rear panel 30. As illustrated, front and rear openings 70, 72 are on the right side of the track device and aligned with one another along a longitudinal axis of the track. Also, as illustrated, there are a pair of front openings disposed on opposite sides of a longitudinal centerline of the track, and a pair of rear openings similarly disposed.

A front flange 74 is attached to the bottom surface of the base wall of rear segment 22 adjacent the front opening 70. Flange 74 extends toward the front edge of the rear opening 72. Flange 74 has a riser 76 connected to the base wall and a ledge or tread 78 extending from riser 76 toward rear wall 30. Tread 78 and riser 76 are preferably perpendicular to one another like the tread and riser of a step of a stairway. Tread 78 receives and supports the supporting foot 80 and acts as a latch for the support foot 80. The latching function is facilitated by riser 76 which flexes moving tread 78 so that the foot 80 can enter between tread 78 and the bottom of the base wall. When foot 80 enters, the riser snaps back into position causing the tread to engage the foot locking the foot in position.

Figure 13:
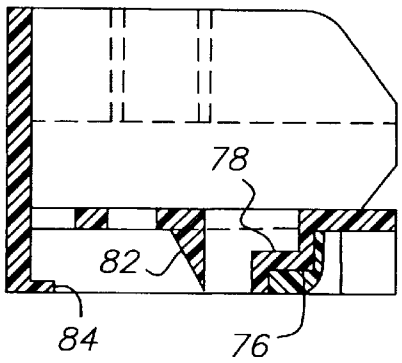
FIG. 13 is a somewhat enlarged sectional view of the rear track segment of FIG. 2 without the foot.
Figure 12:
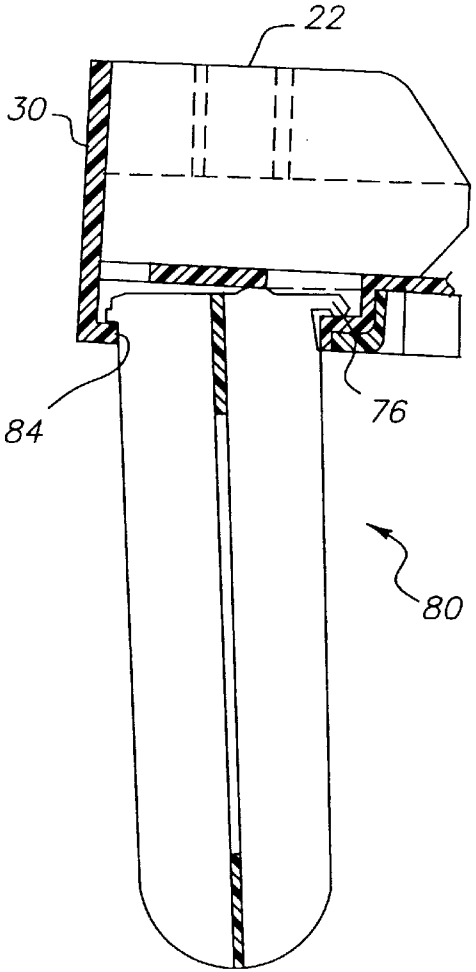
FIG. 12 is a somewhat enlarged sectional view of the rear track segment of FIG. 2 illustrating the foot.

As best illustrated in FIG. 13, an optional intermediate flange 82 extends downward from the bottom surface of rear track segment 22 adjacent the rear edge of front opening 70. Flange 82 cooperates with flange 74 to lock foot 80 in position.

A rear flange 84 is attached to end wall 30 adjacent the rear edge of rear opening 72. Flange 82 extends from rear wall 30 toward the front edge of rear opening 72 and toward front flange 74. The riser portion of flange 82 is an extension of base wall 30. Tread 86 is attached to the riser and is preferably perpendicular thereto. Tread 86 extends from the rear wall 30 and riser toward the front track segment. Tread 78 is at a higher elevation than tread 86 which facilitates angularly orienting the foot relative to the base wall. Notches 88 on either side of the riser allow the riser to flex. When a rear flange is used, an intermediate flange is not required.

Figure 16:
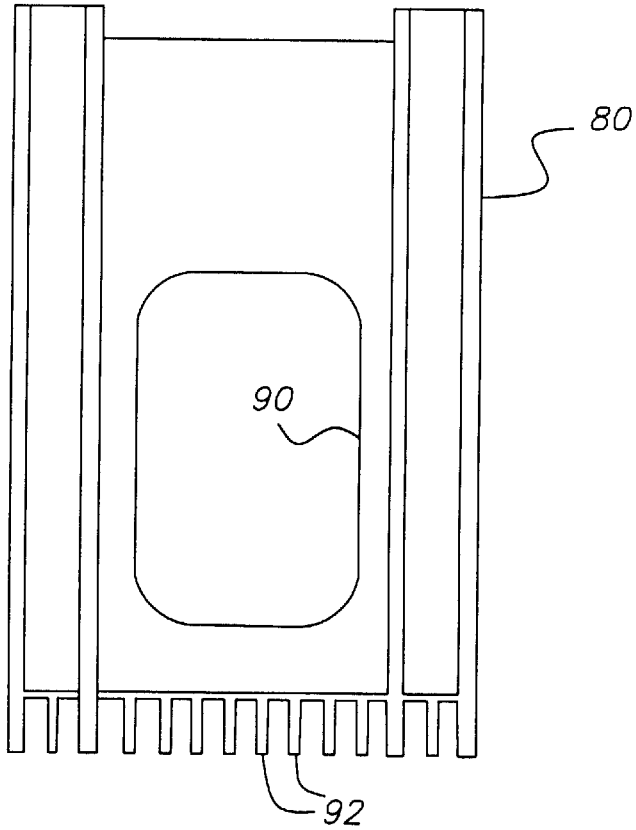
FIG. 16 is a front view of the supporting foot.
Figure 17:
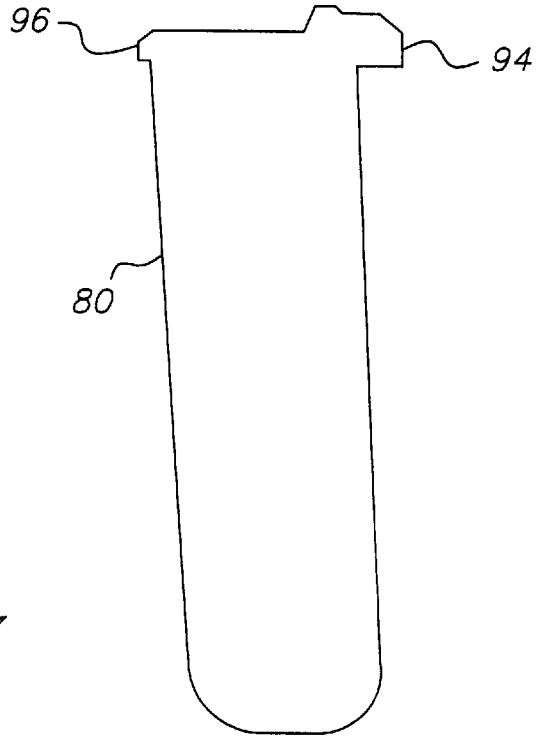
FIG. 17 is a left side view of the supporting foot.

Referring to FIGS. 16–17, foot 80 is attached to the first and second flanges 74, 82 and extends downwardly from the bottom surface of the base wall of rear the track segment. Foot 80 is connected at an angle to the base wall. When foot 80 is in use, it is preferably disposed vertically causing the base wall and track device to slant downwardly with the rear opening 72 being at a higher elevation than the front opening. Foot 80 has a bottom portion with a plurality of parallel guides or ribs 92 extending downwardly to engage wires of a wire shelf to prevent lateral movement of the foot. Adjacent ribs fit over individual wires to laterally anchor the foot. A central opening 90 in the supporting foot promotes air circulation. Air circulation is critical to properly ventilate the articles, especially when the articles are to be dispensed cold.

The top portion of foot 80 has front and rear protrusions or flanges 94, 96 that engage the track device. Front flange 94 extends forward from the main body of the foot to engage front flange 74. The top front corner of flange 94 is truncated for easier assembly. When assembled, the bottom surface of flange 94 rests on the top surface of tread 78. Rear flange 96 extends rearward from the main body to engage rear flange 82. The top rear corner of flange 96 is truncated for easier assembly. When assembled, the bottom surface of flange 96 rests on the top surface of tread 86.

It can now be appreciated that an inclined track device for a merchandising display shelf for a plurality of bottles to slide along has been presented. The elongate display track device has front and rear track segments each having a base wall with opposed sidewalls upstanding from the base wall. The base wall has top and bottom surfaces and defines first and second openings disposed between the sidewalls. Each rectangular opening has first and second opposed edges. A rear end wall is attached to the base wall and the sidewalls and preferably integrally formed therewith to increase structural integrity.

A first flange is attached to the bottom surface of the base wall adjacent the first edge of the first opening and extends toward the second edge of the first opening. A second flange is attached to the rear end wall adjacent the second edge of the second opening and extends therefrom toward the first edge of the second opening and toward the first flange. A foot is attached to the first and second flanges and extends downwardly from the bottom surface of the base wall. The foot and flanges interlock to provide a secure structure for supporting the articles that slide along the track device. Because the supporting foot is at the rear of the track device raising the rear of the track device, the track device is inclined from the front toward the rear allowing the articles to slide forward for dispensing one at a time. While the dimensions of the track device and foot vary, the angle of incline need not be more that about 8° to operated effectively at all times.

The foot and the base wall are connected at an angle so that when the foot is oriented vertically the base wall slants downwardly with the second opening being at a higher elevation than the first opening. The angle permits the foot to stand vertically upright with the base wall of the track device slanted downward toward the front for urging the containers toward the front.

The foot has a plurality of parallel ribs extending downwardly from a bottom portion of the foot. The ribs are adapted to engage wires of a wire shelf to prevent lateral movement of the foot thereby making the inclined track device more stable. Adjacent ribs cooperate to fit about a single wire of the wire shelf locking the foot against lateral movement. The openings in the base wall fit about a lip of the shelf locking the track device against forward movement.

The front segment has first and second upwardly extending arms adjustably attached thereto Each arm has a top portion and a bottom portion with a scalloped surface. A product identification panel is attached to the top portion of the arms. Each sidewall of the front track segment defines a channel that extends transversely along the sidewall perpendicular to the base wall of the front track segment. Each channel has a detent at a top portion thereof adapted to engage the scalloped surface of the bottom portion of one of the arms so that the height of the product identification panel can be adjusted. When properly adjusted the top panel lies above the articles and behind the lead article in the track.

While the invention has been described with particular reference to the preferred embodiments, it will be understood by those skilled in the art that various changes may be made and equivalents may be substituted for elements of the preferred embodiments without departing from invention. For example, while a track device with a single foot has been described, intermediate feet attached to intermediate track segments could be used to provide support for long spans or where it is desired to use thinner material for the track device. And while a foot with double front and double rear locking flanges has been described, single flanges or a mixture of single and multiple flanges could be used.

As is evident from the foregoing description, certain aspects of the invention are not limited to the particular details of the examples illustrated, and it is therefore contemplated that other modifications and applications will occur to those skilled in the art. For example, a single supporting foot could be used to support multiple track devices instead of using multiple feet. It is accordingly intended that the claims shall cover all such modifications and applications as do not depart from the true spirit and scope of the invention.

What is claimed is:

1. An elongate display track device for receiving a row of articles for sliding movement therealong, comprising:

a front track segment having a base wall and opposed sidewalls upstanding from said base wall;

a rear track segment having a base wall and opposed sidewalls upstanding from said base wall, said base wall having top and bottom surfaces, said base wall defining first and second openings disposed between said sidewalls, each of said openings having first and second opposed edges;

a rear end wall attached to said base wall and said sidewalls of said rear track segment;

a first flange attached to said bottom surface of said base wall of said rear track segment adjacent said first edge of said first opening and extending toward said second edge of said first opening;

a second flange attached to said rear end wall adjacent said second edge of said second opening and extending therefrom toward said first edge of said second opening and toward said first flange; and a foot attached to said first and second flanges and extending downwardly from said bottom surface of said base wall of said rear track segment.

2. An elongate display track device, as set forth in claim 1, wherein each of said flanges has a riser connected to said base wall and a tread extending from said riser, said tread forming a ledge for receiving and supporting said foot.

3. An elongate display track device, as set forth in claim 2, wherein each of said risers flexes to move its associated tread to enable connection of said foot.

4. An elongate display track device, as set forth in claim 2, wherein each of said treads is perpendicular to its associated riser.

5. An elongate display track device, as set forth in claim 2, wherein said tread of said first flange is at a higher elevation than said tread of said second flange.

6. An elongate display track device, as set forth in claim 1, wherein said foot and said base wall of said rear track segment are connected at an angle so that when said foot is oriented vertically said base wall slants downwardly with said second opening being at a higher elevation than said first opening.

7. An elongate display track device, as set forth in claim 1, including a plurality of parallel ribs extending downwardly from a bottom portion of said foot, said ribs being adapted to engage wires of a wire shelf to prevent lateral movement of said foot.

8. An elongate display track device, as set forth in claim 1, wherein said foot has a central opening adapted to promote air circulation.

9. An elongate display track device, as set forth in claim 1, including:

first and second upwardly extending arms removably attached to said front track segment, each of said arms having a top portion and a bottom portion with a scalloped surface; and a panel attached to said top portion of said arms.

10. An elongate display track device, as set forth in claim 9, each of said sidewalls of said front track segment defines a channel extending transversely therealong perpendicular to said base wall of said front track segment.

11. An elongate display track device, as set forth in claim 10, wherein each of said channels has a detent at a top portion thereof adapted to engage said scalloped surface of said bottom portion of one of said arms.

12. An elongate display track device, as set forth in claim 1, including:

a first upwardly extending arm removably attached to said front track segment, said first arm defining a slot in a top portion thereof;

a second upwardly extending arm detachably attached to said front track segment, said second arm having a locking flange extending outward from an upper portion thereof; and a panel attached to said arms between said slot and flange.

* * * * *